US005098220A

United States Patent [19]

Norman

[11] Patent Number: 5,098,220

[45] Date of Patent: Mar. 24, 1992

[54] MEMBRANE LINER FOR CASINGHEAD OF OIL WELL OF THE LIKE

[76] Inventor: Carol A. Norman, 1880 Twelve Mile Rd., Remus, Mich. 49340

[21] Appl. No.: 600,622

[22] Filed: Oct. 22, 1990

[51] Int. Cl.[5] ..... E02D 3/00; B65G 5/00

[52] U.S. Cl. ..... 405/52; 166/81; 405/53; 405/270

[58] Field of Search ..... 405/52, 53, 270; 166/81, 364; 175/216

[56] References Cited

U.S. PATENT DOCUMENTS

| | | | |
|---|---|---|---|
| 3,940,940 | 3/1976 | Barrett | 405/270 |
| 4,665,976 | 5/1987 | Retherford | 166/81 |
| 4,673,034 | 6/1987 | Hansen | 166/81 X |
| 4,765,775 | 8/1988 | Kroger | 405/52 |
| 4,802,792 | 2/1989 | Flessas | 405/53 |
| 4,818,151 | 4/1989 | Moreland | 405/270 X |
| 4,960,346 | 10/1990 | Tamayo | 405/52 |

*Primary Examiner*—David H. Corbin
*Attorney, Agent, or Firm*—Basile and Hanlon

[57] ABSTRACT

A covering or liner, capable of surrounding the base of a casinghead of an oil well, which is capable of catching and retaining any fluid that may escape from the casinghead. This covering or liner is a flexible, inextensible, fluid impervious material that is capable of bordering an earthen cavity and surrounding the casinghead of an oil well. This covering or liner has a leak-proof seam to facilitate its installation around the casinghead and a collar to prevent seepage down the casinghead shaft. This invention further contemplates the method for using the same.

3 Claims, 1 Drawing Sheet

MEMBRANE LINER FOR CASINGHEAD OF OIL WELL OF THE LIKE

BACKGROUND OF INVENTION

This invention relates to a containment system and, more particularly, to a means for and method of installing membranes in containment pits for casingheads of oil wells or tanks storing liquids and semi-liquids which are hazardous to the environment. It is known to line cavities in the earth with fluid impermeable sheathing, and particularly, for lining storage tanks or the like. These known coverings are sheets of a flexible and fluid impermeable material. These liners or sheets are usually sealed one to another.

However, these known fluid impermeable sheathings have various drawbacks.

One of these drawbacks is that the lining collapses when the cave is emptied of fluids. Such a collapse often impedes any further utility of the cavity as a container.

Another disadvantage is that is difficult to avoid complete bonding of the sheathing to the cave surface and in this way, avoiding ruptures in the sheathing if there are fissures in the wall of the cavity.

One known solution for these disadvantages is to support the sheathing on a frame.

This solves the stated disadvantages, but other disadvantages are introduced including:

(1) reduction in the cave's capacity, due to the presence of the frame;

(2) an unsatisfortory service-life of the supporting frame, because of corrosion taking place when the frame comes into contact with the fluid that is enclosed in the cave or other cavity serving as a container which requires periodic upkeep and servicing of the frame;

(3) the possibility of contamination of the fluid;

(4) the difficulty in mounting the supporting structure for the sheathing: and (5) the high cost involved for lining a cave or other cavity.

Certain other drawbacks are directed expressly to casingheads of oil wells. How to get the membrane to form a seal around the shaft of the casinghead? How to get the membrane around an established casinghead and still have a membrane that is properly sealed against fluids? How to get the membrane around an existing storage tank and still have a membrane that is properly sealed against fluids?

An object of the present invention is to provide a fluid impermeable membrane for lining cavities in the ground. Another object of the present invention is to provide a fluid impermeable membrane that is adaptable to all types of casingheads for all types of wells, i.e. oil wells, gas wells, injection wells and disposal wells. Still another object of the present invention is to provide a fluid impermeable membrane that is capable of being adaptable to all types of existing storage tanks or the like.

Other objects will become apparent from the following description with reference to the accompanying drawings wherein:

DETAILED DESCRIPTION OF THE PREFERRED EMBODIMENTS

The foregoing objects and others are accomplished in accordance with this invention. Generally speaking, by providing a membrane liner of fluid impermeable, flexable and inextensible sheet material for lining a cavity adjacent to a well or storage tank, so as to prevent fluid spill in the area around the well or storage tank.

Figure 1:
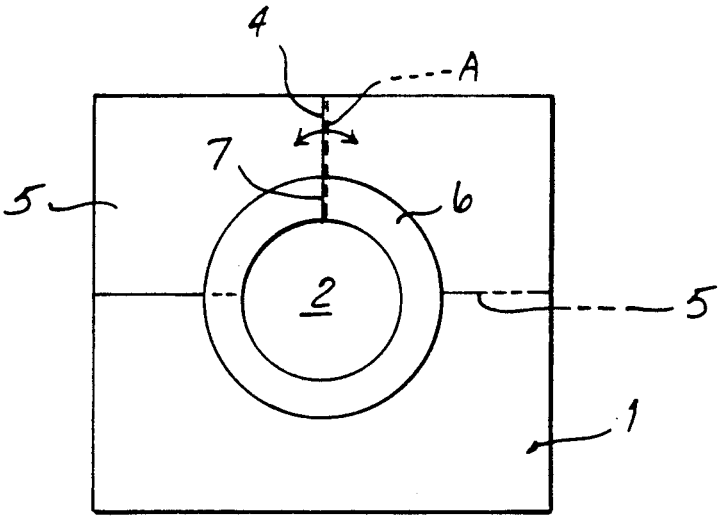
FIG. 1 is a top view of the membrane liner.

One embodiment for the containment pit around oil wells or the like is illustrated in FIG. 1.

Figure 3:
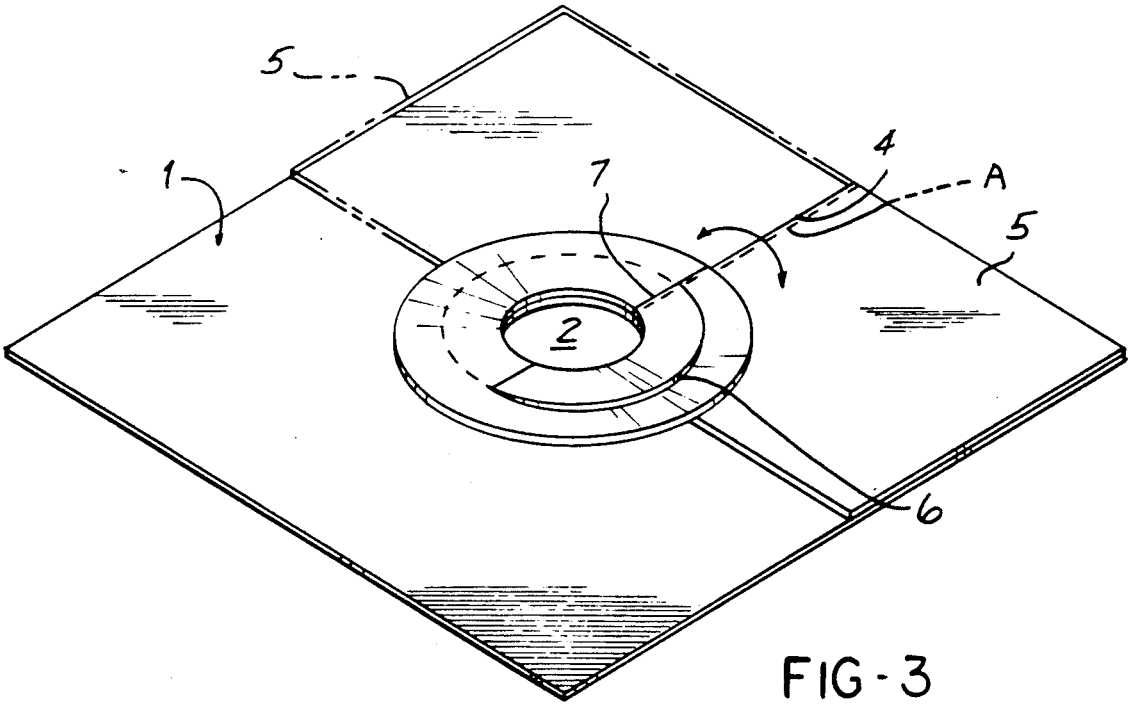
FIG. 3 is a perspective view of membrane liner showing another alternate embodiment with the membrane leaf in the unsealed position according to the present invention.

As shown in FIG. 1, the impervious, flexable membrane liner 1 has an opening 2 which is capable of receiving and surrounding a casinghead 3 of an oil well or the like. The impervious, flexible membrane liner 1 has a channel 4 through which the casinghead 3 of an oil well or the like can pass and occupy the opening 2. The impervious, flexible membrane liner 1 has affixed thereto an impervious, flexible membrane leaf 5, fixed by a suitable adhesive A as seen in FIGS. 1 and 3. This impervious, flexible membrane leaf 5 is capable of overlapping the channel 4 once the casinghead 3 of an oil well or the like is positioned within the opening 2 and thus providing a seal over channel 4 with the impervious, flexible membrane liner 1. The relative movement of leaf 5 with respect to liner 1 is shown by the arched arrow in FIGS. 1 and 3.

Surrounding the opening 2 is a collar 6 that surrounds the casinghead 3 of the oil well or the like and is affixed to the impervious, flexible membrane liner and provides a seal between the collar 6 and the casinghead 3. This collar 6 also has a second channel 7 that permits the casinghead 3 to pass through the collar 6 and occupy the opening 2.

The material used to make the membrane described herein depends upon the chemical properties of the liquid in the wells, tanks, pipes, and pumps. The preferred material for this invention for the containment of these various substances includes a DuPont polyester elastomer sold under the trademark "HYTREL".

Figure 2:
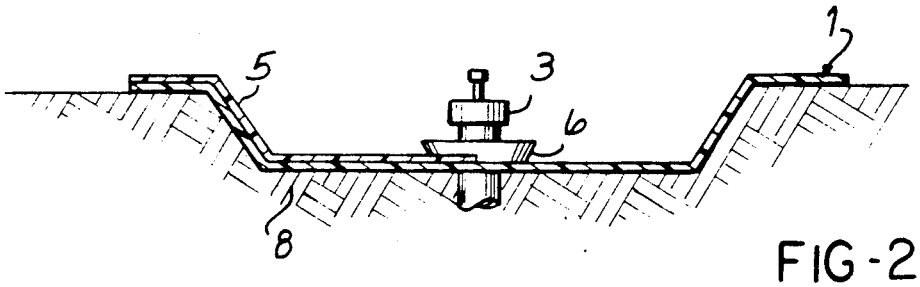
FIG. 2 is a cross section of a tract of a cave that is provided with a membrane liner around a casinghead of a well according to the present invention.

FIG. 2 is a cross section of a tract of a cave 8 which is surrounding the casinghead 3 of an oil well or the like and wherein the impervious, flexible membrane liner 1 is laid. The impervious, flexible membrane liner 1 may be anchored to the cave 8 by any means applicable to achieve the objects of this invention. As shown in FIG. 3, the impervious, flexible membrane leaf 5 is in an open position. Those who are skilled in the art will readily perceive how to modify the system. Therefore, the appended claims are to be construed to cover all equivalent structures which fall within the true scope and spirit of the invention.

What is claimed:

1. A liquid impervious, flexible membrane liner capable of being formed and adapted to a containment pit for oil wells or the like, used as a reservoir for collecting liquids, such as petroleum based liquids, the membrane liner comprising:

an impervious, flexible membrane liner having an access channel to an opening, said access channel and said opening being capable of receiving a casinghead of an oil well;

an impervious, flexible membrane leaf affixed to said membrane liner and adjacent to said access channel and capable of being positioned over the access channel once said casinghead is in said opening;

means for affixing said membrane leaf to said membrane liner once said membrane leaf is positioned over said access channel; and an impervious, flexible collar having a second access channel therein and affixed to said membrane liner around said opening and surrounding said casinghead.

2. The flexible membrane liner as defined in claim 1 wherein the impervious, flexible membrane is made from a polyester elastomer.

3. A liquid impervious, flexible membrane liner capable of being formed and adapted to a containment pit for storage tanks or the like, used as a reservoir for collecting liquids, such as petroleum based liquids, the membrane liner comprising:

an impervious, flexible membrane liner, having an access channel to an opening, said access channel and said opening being capable of receiving a storage tank;

an impervious, flexible membrane leaf affixed to said membrane liner and adjacent to said access channel and capable of being positioned over the access channel once said storage tank is in said opening;

means for affixing said membrane leaf to said membrane liner once said membrane leaf is positioned over said access channel; and an impervious, flexible collar having a second access channel therein and affixed to said membrane liner around said opening and surrounding said storage tank.

* * * * *